US007407306B2

(12) United States Patent
DeMarb et al.

(10) Patent No.: US 7,407,306 B2
(45) Date of Patent: Aug. 5, 2008

(54) AERODYNAMIC LIGHTED DISPLAY PANEL

(75) Inventors: Jeffrey L. DeMarb, Fond Du Lac, WI (US); Vladimir Volochine, Safety Harbor, FL (US)

(73) Assignee: Waytronx, Inc., Safety Harbor, FL (US)

( * ) Notice: Subject to any disclaimer, the term of this patent is extended or adjusted under 35 U.S.C. 154(b) by 8 days.

(21) Appl. No.: 11/351,252

(22) Filed: Feb. 10, 2006
(Under 37 CFR 1.47)

(65) Prior Publication Data

US 2006/0209528 A1 Sep. 21, 2006

Related U.S. Application Data

(60) Provisional application No. 60/651,204, filed on Feb. 10, 2005.

(51) Int. Cl.
*F21V 29/00* (2006.01)

(52) U.S. Cl. ..... 362/294; 362/393; 362/345; 362/218

(58) Field of Classification Search ..... 362/294, 362/373, 264, 345; 40/212
See application file for complete search history.

(56) References Cited

U.S. PATENT DOCUMENTS 5,685,634 A * 11/1997 Mulligan ..... 362/237
6,065,854 A * 5/2000 West et al. ..... 362/249
2006/0007691 A1* 1/2006 Depenbusch et al. ..... 362/382

OTHER PUBLICATIONS

Notification of Transmittal of International Search Report and Written Opinion dated Oct. 12, 2007 in Application No. PCT/US06/04615.

* cited by examiner

*Primary Examiner*—Ali Alavi
*Assistant Examiner*—Evan Dzierzynski
(74) *Attorney, Agent, or Firm*—Banner & Witcoff, Ltd

(57) ABSTRACT

A lighted display panel includes a plurality of illumination layers, with each layer having leading and trailing edges. Each of the layers has a cross section in which the leading and trailing edges are angled toward an upper or lower face of the layer. In some cases, the leading and trailing edges are offset from one another. In other cases, the illumination layer has a wing shape. Lighting elements (e.g., LEDs) are located in the leading edges of the illumination layers. The illumination layers define vents through which air may flow, but which obstruct the passage of light.

18 Claims, 3 Drawing Sheets

AERODYNAMIC LIGHTED DISPLAY PANEL

CROSS-REFERENCE TO RELATED APPLICATIONS

This application claims the benefit of U.S. Provisional Application Ser. No. 60/651,204, filed Feb. 10, 2005 and titled "Aerodynamic Lighted Display Panel," which application is incorporated by reference herein.

FIELD OF THE INVENTION

The invention relates generally to lighted displays and signs that display custom messages, such as LED panels and the like. More specifically, the invention provides an aerodynamic array configuration for a display panel, thereby reducing wind resistance of the panel.

BACKGROUND OF THE INVENTION

Lighted display panels, such as LED panels and the like, are used for a variety of purposes, including providing traffic information via signs over highways or in subway stations, scrolling various messages across single or multi-color displays, and presenting information or replays during sporting events in large arenas, among other uses. Lighted display panels are well known in the art, and many patents have been granted for various aspects of their design.

However, a common problem in the art is that known lighted display panels inherently have high wind resistance due to their solid surfaces and their considerable sizes that are needed to be visible from long distances. It would thus be an advancement in the art to provide a physical housing configuration, or form factor, for a lighted display panel that provides venting or other physical characteristics to allow wind and elements to pass through the lighted display panel.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In at least some embodiments, a lighted display panel may include a display housing enclosing two or more separately enclosed separated layers of linearly arranged lighting elements. The layers are spaced apart to form a channel through which air can pass, and each layer may include an enclosed layer housing having a leading edge, a trailing edge, a top surface, and a bottom surface, with the leading edge offset from the trailing edge. An intended viewing angle of the display panel may be incident to a top or bottom surface.

In other embodiments, each enclosed layer housing may have an airfoil-shaped cross-section. The leading edge and the trailing edge may recede into portions of the layer having equal or different heights. In each layer the linearly arranged lighting elements may be equally spaced.

In still other embodiments, a lighted display panel may further include one or more support plates arranged vertically in the display panel where the normal of each support plate is substantially parallel along the length of each layer. The support plate may have cutouts in a shape of the cross-section of each layer thereby providing vertical support within the display panel.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Aspects of the invention provide an aerodynamic display panel that allows wind and rain to pass through openings or vents in the display panel housing, while still maintaining sufficient contrast to distinguish lit and unlit lighting elements of the display panel forming a message to viewers of the display panel. As described in more detail below, the aerodynamic display panel comprises a plurality of stacked layers, louvers, or wings with sufficient space between layers to provide flow-through vents through which air, rain, and other elements may pass. The layers are shaped in such a manner such that, when viewing the display panel from a typical or intended viewing angle, a viewer cannot see through the flow-through vents, which would cause the viewer to see whatever is behind the display panel, thus causing confusion or an inability to read a message displayed on the display panel. Instead, layers are shaped in such a manner that a viewer sees the housing of the layer above or below the vent, thereby providing sufficient contrast for viewing a message displayed on the display panel.

Figure 1:
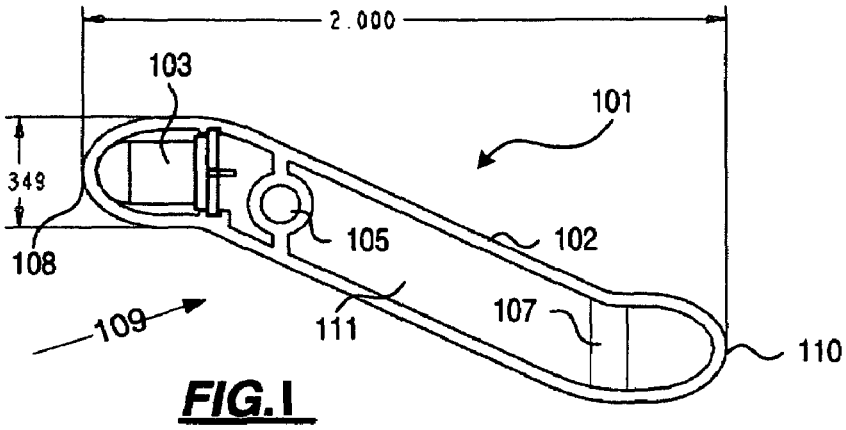
FIG. 1 illustrates a cross-sectional view of a light housing that may be used according to an illustrative embodiment of the invention.
Figure 6:
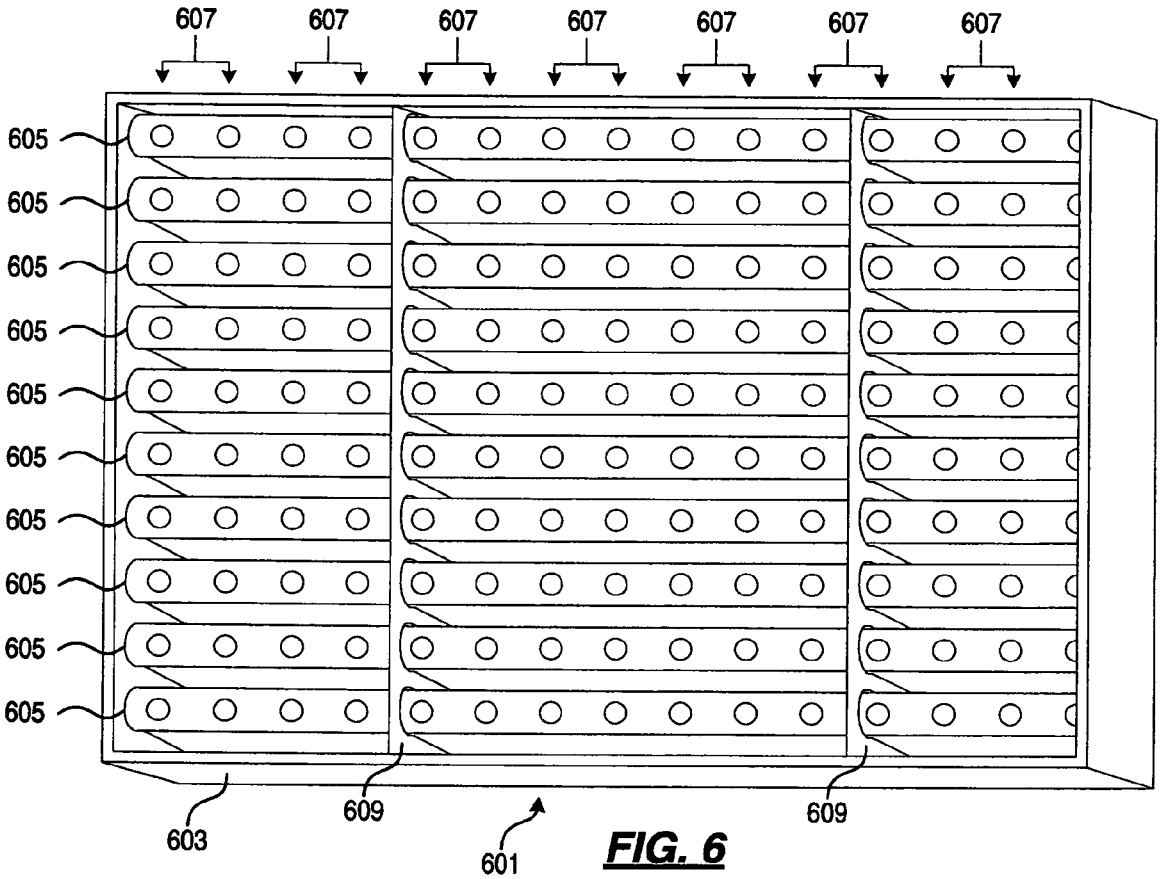
FIG. 6 illustrates an aerodynamic lighted display panel according to an illustrative embodiment of the invention.

FIG. 1 illustrates a cross-section of a layer 101 that may be used according to an illustrative embodiment of the invention. The dimensions in FIG. 1 are provided in inches. The cross-sectional view of layer housing 102 illustrates only a single lighting element 103, e.g., a light emitting diode (LED), located at the position of the cross-section. However, each layer preferably houses a plurality of lighting elements 103 such that when a plurality of layers are configured as described herein, the result is an array of lighting elements as illustrated in FIG. 6. While LEDs are commonly used in display panels, any type of lighting element may be used, as is known in the art. In addition, each lighting element may comprise a plurality of individual lights to provide multiple colors or different brightness levels. Electrical circuitry of the display panel may run through a hollow interior 111 of housing 102, and housing 102 is preferably completely enclosed or encapsulated to provide protection of the electrical components from environmental hazards (e.g., weather, dirt, sand, smog, chemicals, etc.).

Layer housing 102 may include one or more horizontal support receivers 105 and/or one or more vertical support receivers 107. A dowel, rod or other support beam may be inserted through vertical support receiver 107 and/or horizontal support receiver 105 to hold the layer 101 in position and/or provide rigidity to the layer 101 where the layer housing is otherwise constructed of a flexible material. Each support beam may be attached at either end to a display housing 603 (FIG. 6). Layer housing 102 is preferably dark in color to provide contrast to the lighting elements 103 of each layer. A leading edge 108 of each layer housing 102 may be clear or otherwise translucent to allow each lighting element 103 to be visible external to the display panel.

Layer housing 102 is preferably configured such that the layer turns, curves, or arcs in a direction crossing an intended viewing angle 109 of the display panel, thus making layer housing 102 incident to the intended viewing angle. While the layer housing 102 could ultimately cross the intended viewing angle by turning in either of two directions (i.e., up or down), the layer housing 102 preferably turns, curves, or arcs in the direction requiring the smallest turn angle in order to cross the intended viewing angle in a given amount of space. For example, most display panels are viewed horizontally or from an angle below horizontal (i.e., the viewer is typically even with or at a lower elevation than the display panel), thus each layer housing 102 should turn, curve or arc downward from its leading edge 108 such that the trailing edge 110 is offset below the leading edge 108. In the instances where the display panel is viewed from above, each layer housing 102 may turn, curve or arc upward from its leading edge 108. A trailing edge 110 of the layer housing 102 may be configured such that wind passing from behind the display panel can pass with the same reduced resistance as from the front of the display panel. The distance from leading edge to trailing edge is referred to as the layer width, whereas the thickness of each layer is referred to as the layer height. The length of each layer is the distance from one side of the display panel to the other, and it is the distance that primarily limits the number of lighting elements that may be housed in each layer. The form factor illustrated in FIG. 1 creates equal wind loading in either wind direction, i.e., front to back and back to front.

Figure 2:
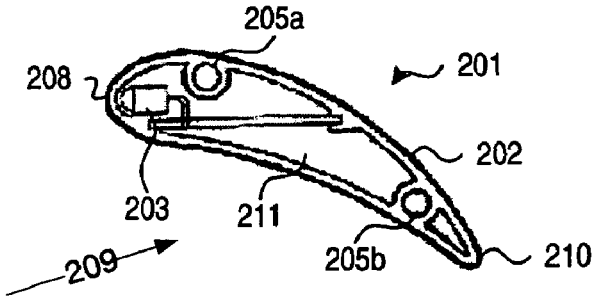
FIG. 2 illustrates a cross-sectional view of another light housing that may be used according to an illustrative embodiment of the invention.

FIG. 2 illustrates a cross-section of an alternative form factor that may be used according to an illustrative embodiment of the invention. In FIG. 2, layer 201 has a dark colored, wing-shaped housing 202 having hollow interior 211, lighting elements 203 (only one shown), horizontal support receivers 205*a*, 205*b*, leading edge 208 with a clear or translucent cover, and trailing edge 210. In FIG. 2, an intended viewing angle 209 is similar to that of FIG. 1. FIG. 2 illustrates a configuration using two horizontal supports and no vertical supports.

Figure 3:
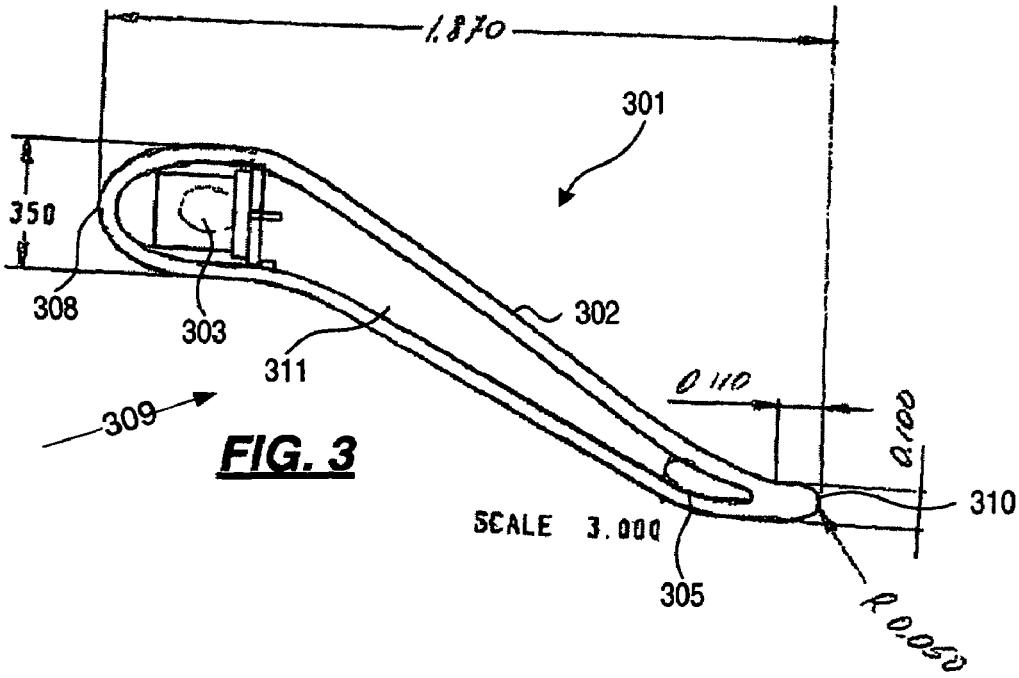
FIG. 3 illustrates a cross-sectional view of yet another light housing that may be used according to an illustrative embodiment of the invention.

FIG. 3 illustrates a cross-section of an alternative form factor that may be used according to an illustrative embodiment of the invention. The dimensions in FIG. 3 are provided in inches. In FIG. 3, layer 301 has a dark colored, S-wedge housing 302 having hollow interior 311, lighting elements 303 (only one shown), horizontal support receiver 305, leading edge 308 with a clear or translucent cover, and trailing edge 310. In FIG. 3, an intended viewing angle 309 is similar to that of FIG. 1. FIG. 3 illustrates a configuration using only a single horizontal support and no interior vertical supports (vertical support is provided at either end of layer housing 302, or using support plates 609, further described below and shown in FIG. 6).

In any of the embodiments illustrated in FIGS. 1-3, vertical supports 107 as described above might not be used, and instead optionally replaced with one or more pieces of vertical sheet metal (e.g., 0.80" thick aluminum sheet) plates 609 (FIG. 6) in which holes are cut equal to the outer profile (cross-sectional shape) of the layer with the desired vertical pitch (in one embodiment, 0.69"). In embodiments using vertical plates 609, the number of plates used may depend on the length of each layer. The vertical plates 609 may be attached to the display housing, integrated with the display housing, or be separate altogether. The width of each plate 609 may be 0.1"-0.2" larger than the profile, and each plate 609 might be located between two LEDs' openings in the layers. The vertical plates 609 therefore only minimally block air flow and also only minimally affect the visual characteristics of the display, if at all. The length of the plates 609 may depend on the number of layers used in the display panel. The holes in each plate 609 may be cut using a lathe cut CNC machine. Punch or press techniques may alternatively be used. Once each layer is inserted into the vertical plates 609, the layers are thereby prevented from twisting.

Also in any of the embodiments illustrated in FIGS. 1-3, an alternative configuration may be used where horizontal receiver 105, 205, 305 is used for running cabling and installing internal components of the layer housing. In such a configuration, each layer is fixed to the display housing at each layer's ends and optionally supported using plates 609. In any embodiment, in order to reduce weight, each layer might be divided into two portions: a head portion using aluminum extruded housing for electronic and electric components; and a tail portion using plastic extrusion for blocking stray light from the back of the sign. The two portions may be joined together by sliding gripping features of one portion inside of retaining slots of the other. The hole in the aluminum extrusion may be used for attaching the sealing caps at the edges of each layer.

Figure 4:
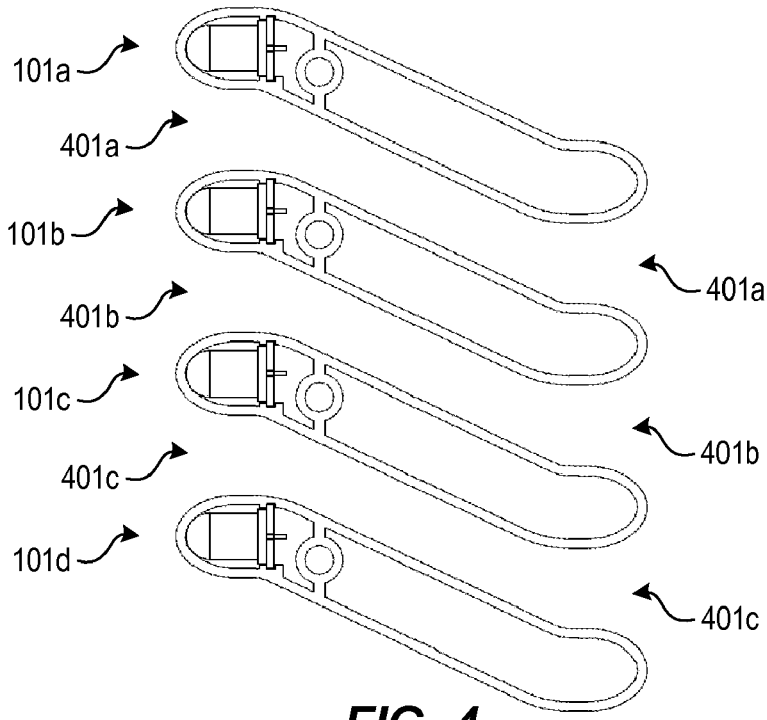
FIG. 4 illustrates a cross-section of a plurality of the light housings illustrated in FIG. 1.

FIG. 4 illustrates a plurality of layers 101*a*, 101*b*, 101*c*, and 101*d* (collectively, 101) arranged for use in a display panel housing (not shown), according to an illustrative embodiment of the invention. The plurality of layers, each housing a plurality of lighting elements, form an array of lighting elements that may be selectively turned on and off to form a lighted message on the display panel. The layers are arranged with space between each layer to form pass-through vents 401*a*, 401*b*, and 401*c* (collectively, 401). Air, wind, rain, sleet, snow, etc can more easily pass through vents 401 than through previously known display panels, while the display panel maintains sufficient contrast for a viewer to view a message displayed on the display panel.

Figure 5:
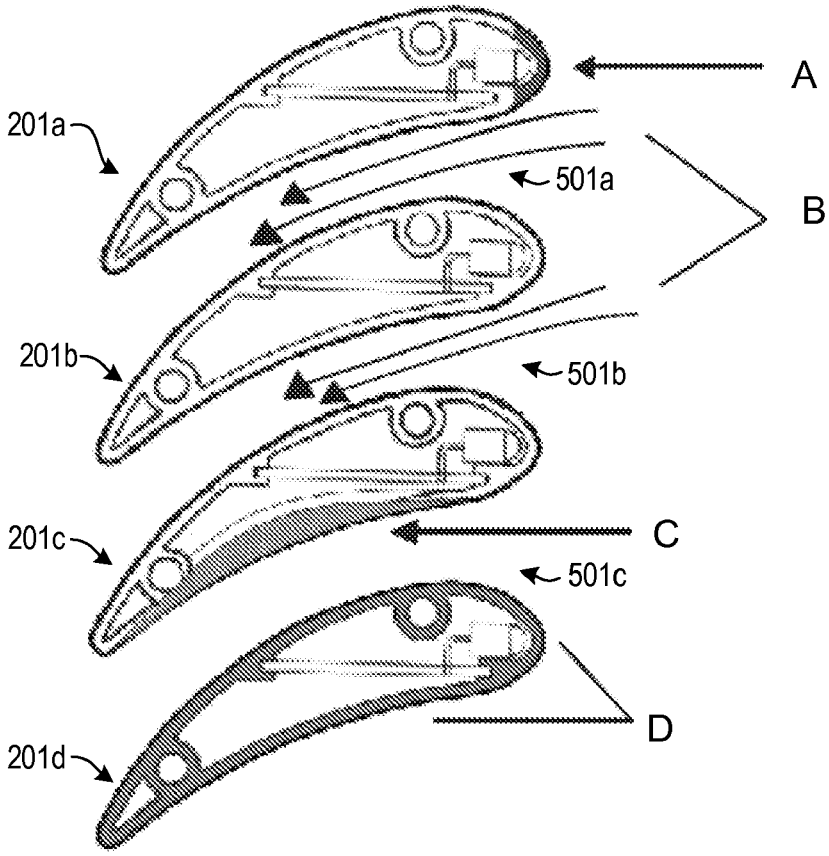
FIG. 5 illustrates a cross-section of a plurality of the light housings illustrated in FIG. 2.

FIG. 5 illustrates an alternative plurality of layers 201*a*, 201*b*, 201*c*, and 201*d* (collectively, 201) arranged for use in a display panel housing (not shown), according to an illustrative embodiment of the invention. The plurality of layers, each housing a plurality of lighting elements, form an array of lighting elements that may be selectively turned on and off to form a lighted message on the display panel. The layers are arranged with space between each layer to form pass-through vents 501*a*, 501*b*, and 501*c* (collectively, 501). The wing-shaped design, e.g., indicated by section B, reduces wind effects on each layer. Air, wind, rain, sleet, snow, etc can more easily pass through vents 501 than through previously known display panels, while the display panel maintains sufficient contrast for a viewer to view a message displayed on the display panel. Further, the complete environmental encapsulation, e.g., as indicated at Section D, protects the lighting elements from external conditions such as rain, wind, debris, and the like.

Each leading edge of each layer housing, or at a minimum a portion of the leading edge covering each lighting element, may be made of a clear or translucent polycarbonate impact resistant cover, e.g., as shown by arrow A, thereby allowing viewers to see each lighting element while providing sufficient protection of each lighting element. The cover may also reduce glare to a viewer to the display panel. As indicated above, each layer housing is preferably made of a dark color or a color that provides contrast, e.g., as shown by arrow C, with lit lighting elements. At a minimum, each layer preferably has the dark or contrasting color at the locations incident to the intended viewing angle of the display panel. In embodiments using a wing or airfoil type design, the repeated airfoil layers may act to counteract effects of lift resulting from the airfoil design. However, the airfoil design may still be unsuitable in areas receiving high winds. In such areas a form factor utilizing countervailing top and bottom slat surfaces, such as are illustrated in FIGS. 1, 2 and 4, may be used.

The dimensions of each layer can vary depending on the size of each lighting element, components inside each layer and their composition, the size of the display panel, and based on other needs of the user of the display panel. Dimensions may also be limited by the pitch of each layer and the value of the required angle to limit stray light when viewed from within an intended viewing angle or range of angles. In one illustrative embodiment of the invention, the width of each layer is approximately two (2) inches.

FIG. 6 illustrates a display panel 601 having display housing 603 and a plurality of layers 605. Wiring and circuitry may be run internal to layers 605 and/or housing 603. Each layer 605 houses one or more lighting elements 607 that can be selectively turned on and off by a display panel controller (not shown) to create a message or picture for display on the display panel 601. Each layer 605 is preferably substantially the same as other layers, and utilizes a housing form factor such as is illustrated in FIGS. 1-3, or any other form factor as described herein. Portions of each layer may be made of plastic to decrease the overall weight of each display panel.

The aerodynamic display panel described herein preserves life and reduces risk by encapsulating each LED in an environmentally secure housing to survive in extreme conditions. The array of lighting elements, arranged in a plurality of separated layers, reduces resistance to wind and water by allowing them to pass through the display panel. According to some embodiments of the invention, the layers may be simultaneously louvered to a desired angle to provide optimum wind resistance. The display panel design described herein also supports effective heat dissipation by encouraging convective air currents to pass over and through the array (similar to a radiator) to dissipate heat. Because the life of an LED is directly related to removal of heat from the LED junction, this also helps preserve the longevity of each LED (or other lighting device) in the display panel. Getting the heat onto the aluminum extrusion very quickly facilitates rapid heat dissipation.

The display panel may be scaled up or down accordingly to an appropriate size for the desired use. In addition to use on fixed variable message signs, for example those over highways and on other fixed structures, the display panel may also be adapted to connect to or be permanently attached to a display stand, thereby allowing portability of the display panel to various locations as needed. The wind resistant qualities of the display panel described herein help to offset the often minimal wind resistant strength of portable stands. The stand may be a folding tripod or similar device, and may include one or more anchors for tying down or hammering into a surface on which the stand is placed. Similarly, a portable battery may be included with the display stand to negate the need for a gas-powered or other electrical generator.

The present invention includes any novel feature or combination of features disclosed herein either explicitly or any generalization thereof. While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth herein.

We claim:

1. A display panel, comprising:

a display housing having a front and a rear;

a plurality of illumination layer enclosures extending across the display housing, each of the illumination layer enclosures having an upper surface, a lower surface, a leading portion situated toward the display housing front, and a trailing portion situated toward the display housing rear; and a plurality of lights contained within each of the illumination layer enclosures and distributed along the leading portions thereof, wherein the illumination layer enclosures define a plurality of vents through which air may pass from the front to the rear, at least one of the leading and trailing portions of each illumination layer enclosures is angled toward one of the upper and lower surfaces of that layer, the illumination layer enclosures are positioned so that, when the display panel is viewed from the front at an intended viewing angle, the pluralities of lights are visible and passage of light between the illumination layer enclosures is obstructed; and wherein each of the illumination layer enclosures has a wing-shaped cross section having an upper arcuate surface and a lower arcuate surface, the upper and lower arcuate surfaces meeting at a front portion that is thicker than a rear portion at which the upper and lower arcuate surfaces meet.

2. The display panel of claim 1 wherein, as to each of the illumination layer enclosures, the leading portion is angled toward the lower surface, the trailing portion is angled toward the upper surface, and the leading and trailing portions are offset from and parallel to one another.

3. The display panel of claim 1, wherein the leading portion of each of the illumination layer enclosures is formed from a transparent or translucent material.

4. The display panel of clam 1, wherein one of the upper and lower surfaces of each of the illumination layer enclosures is incident to the intended viewing angle and is darkly colored.

5. The display panel of claim 1, further comprising a plurality of support plates arranged perpendicular to the illumination layer enclosures, each of the support plates having a plurality of cutouts through which the illumination layer enclosures extend.

6. The display panel of claim 1, wherein the plurality of lights contained within each of the illumination layer enclosures is distributed adjacent the leading portions of the illumination layer enclosures.

7. A display panel, comprising:

a display housing;

a plurality of illumination layer housings arranged in parallel within the display housing, each of the illumination layer housings including a leading portion, a trailing portion and a cross section, the cross section including at least one curve or angle therein, wherein the cross section of each of the illumination layer housings has a wing-like shape having an upper arcuate surface and a lower arcuate surface, the upper and lower arcuate surfaces meeting at a front portion that is thicker than a rear portion at which the upper and lower arcuate surfaces meet; and a plurality of lights located within each of the illumination layer housings and distributed along the leading portions thereof, and wherein the leading portions of the illumination layer housings are located closer to the display housing front than to the display housing rear, and the illumination layers define a plurality of air flow paths from the front to the rear.

8. The display panel of claim 7, further comprising a plurality of support plates arranged perpendicular to the illumination layer housings, each of the support plates having a plurality of cutouts through which the illumination layer housings extend.

9. The display panel of claim 7, wherein each of the lights is a light emitting diode.

10. The display panel of claim 7, wherein each of the leading portions comprises a transparent material.

11. The display panel of claim 7, wherein each of the leading portions comprises a translucent material.

12. The display panel of claim 7, wherein the cross section of each of the illumination layer housings includes a straight central portion joining the leading and trailing portions, and wherein the leading and trailing portions of each illumination layer housing are substantially parallel to and offset from one another.

13. The display panel of claim 7, wherein the leading portion of each of the illumination layer housings has a thickness greater than a thickness of the trailing portion of that illumination layer housing.

14. The display panel of claim 7, wherein at least part of each of the illumination layer housings is darkly colored.

15. The display panel of claim 7, wherein each of the illumination layer housings includes a first support reciever extending along the length of that illumination layer housing.

16. The display panel of claim 15, wherein each of the illumination layer housings includes a plurality of second support receivers perpendicular to the first support receivers of that illumination layer housing.

17. The display panel of claim 7, wherein the plurality of lights located within each of the illumination layer housings is distributed adjacent the leading portions thereof.

18. A display panel, comprising:

a display housing having a front and a rear, a first side and a second side;

a plurality of illumination layers extending across the display housing from the first side to the second side, each of the illumination layer enclosures having a planar top surface, a planar bottom surface, a leading portion situated toward the display housing front and joining the top and bottom surfaces, a trailing portion situated toward the display housing rear and also joining the top and bottom surfaces, and a cross section in which the leading portion is angled toward the bottom surface and the trailing portion is angled toward the top surface;

a plurality of lights contained within the illumination layer enclosures and distributed along the leading portions thereof; and a plurality of support plates arranged perpendicular to the illumination layer enclosures, each of the support plates having a plurality of cutouts through which the illumination layer enclosures extend, and wherein the leading portion of each illumination layer enclosure is formed from a transparent material, and the plurality of illumination layer enclosures define a plurality of vents through which air may flow from the front to the rear.

* * * * *